United States Patent [19]

Salete-Garces

[11] 4,292,890

[45] Oct. 6, 1981

[54] GRAIN POLISHING AND WHITENING MACHINE

[76] Inventor: Felipe Salete-Garces, Avenida Ano de Juarez 198, Granjas San Antonio, Iztapalapa, Mexico, 13, D.F.

[21] Appl. No.: 96,269

[22] Filed: Nov. 21, 1979

[30] Foreign Application Priority Data

Jan. 24, 1979 [MX] Mexico ..... 176383

[51] Int. Cl.[3] ..... B02B 3/04; B02B 3/06

[52] U.S. Cl. ..... 99/603; 99/606; 99/607; 99/608; 99/610; 99/611; 99/614; 99/617

[58] Field of Search ..... 99/602–607, 99/610–615, 617, 608, 622, 628; 241/86.1, 88.2, 93; 51/4, 22, 72 R

[56] References Cited

U.S. PATENT DOCUMENTS

| | | | |
|---|---|---|---|
| 8,879 | 9/1879 | Morgan | 99/607 |
| 25,594 | 9/1859 | Ward | 99/607 |
| 315,997 | 4/1885 | Beardslee | 99/607 |
| 866,100 | 9/1907 | Watkins | 99/606 |
| 1,020,377 | 3/1912 | Walker | 99/606 |
| 3,566,943 | 3/1971 | Witt | 241/88.2 |
| 3,960,068 | 6/1976 | Salete | 99/606 |

*Primary Examiner*—Robert W. Jenkins
*Assistant Examiner*—Timothy F. Simone
*Attorney, Agent, or Firm*—Sughrue, Mion, Zinn, Macpeak and Seas

[57] ABSTRACT

A grain polishing and whitening machine, particularly adapted for treatment of rice, comprises a base box, housing means having first, second, third and fourth coaxially arranged housing sections, said second housing section being coaxially mounted on said first housing section such that it may be rotatably displaced with respect thereto, said third section being coaxially mounted on said second section, and said fourth section being coaxially mounted on said third section such that it can be rotatably displaced with respect thereto, concentric hollow rotor means extending through said first, second and third housing sections, grain feed means in said second housing section, screw conveyor means within said second housing section and having a helical rib lined with an abrasive layer, for displacing and rubbing said grains along said second housing section and into the third housing section, cylindrical indented screen means in said third housing section adjustable, diametrically opposed, diagonally fluted knife means tangentially mounted on said rotor means along the length of said rotor means, and complementary diametrically opposed fluted knife means mounted on said screen means along the length of said screen means, to cooperate with said knife means mounted on the rotor means, the diagonal flutes of said knife means benin oriented to oppose the driving action of said screw conveyor means to thereby compact the mass of grains between said rotor means and said screen means, and grain discharge means in said fourth housing section.

13 Claims, 17 Drawing Figures

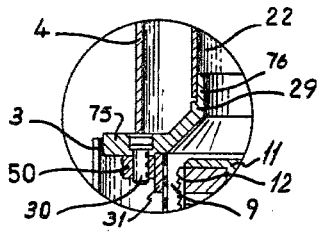
Fig.6.
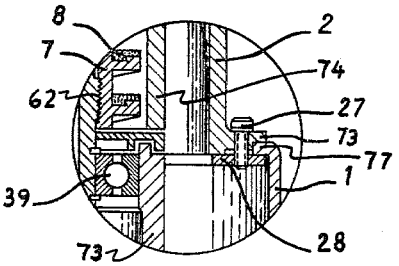
Fig.5.
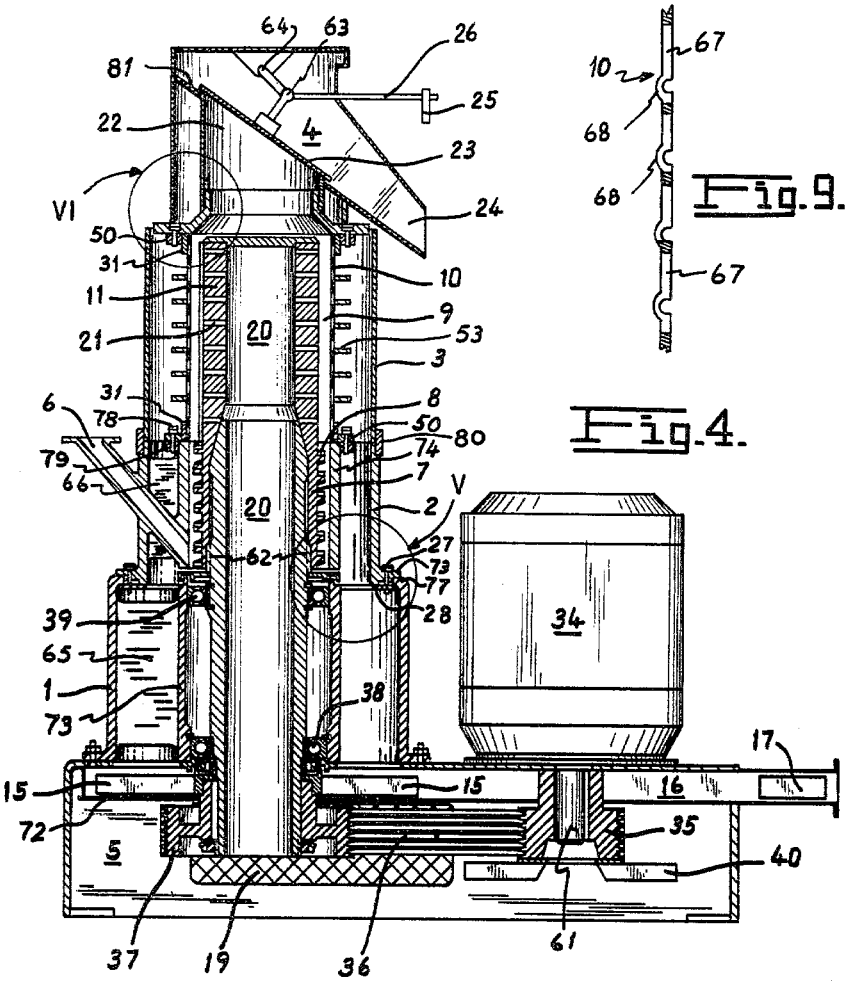
Fig.9.
Fig.4.

GRAIN POLISHING AND WHITENING MACHINE

FIELD OF THE INVENTION

The present invention refers to a grain polishing and whitening machine, particularly to a machine for polishing and whitening rice, which is capable of effecting husking of a large proportion of unhusked grains, as well as polishing and whitening of said rice grains in one single step.

BACKGROUND OF THE INVENTION

It is a well known fact, particularly when rice grains are to be husked, polished and whitened, that rice mills are generally designed such that breakage of the grain is avoided as much as possible, particularly in the stages of husking and of polishing and whitening the grain.

For the purpose of husking, as well as polishing and whitening cereal grains, particularly rice, many different types of machines are very well known in the art, all of them working in separate stages, namely, a husking stage and a polishing and whitening stage. It is also well known that the husking machines must deliver completely husked grain to the polishing and whitening machines, because the latter are uncapable of handling unhusked grains, whereby the husking stage generally needs several steps carried out by tandems of husking machines and/or by husking machines followed by unhusked grain removing machines.

Different designs of whitening and polishing machines are well known but, up to the present time, no machine has been designed that may effect a complementary husking of the grain to avoid the use of unhusked grain removing machines, as well as the polishing and whitening thereof in one single step, with the consequent increases in the cost of fully husking the grains and the consequent cumbersome procedure that must be used with said type of tandem husking machines and unhusked grain removing machines to deliver a fully husked grain to the polishing and whitening machines.

Among the most well known grain polishing and whitening machines are those using emery cones or emery cylinders to polish and whiten the grains by means of rubbing of the same with emery, producing a polished grain and flour from the rubbed portions thereof, but these machines are extremely bulky and heavy and their operation requires high power consumption, whereby the process carried out in the same is rather costly.

Also polishing and whitening machines for horizontal operation and machines for vertical operation are well known, but in machines designed for horizontal operation, grain elevators are required which are of rather intricate construction and increase the cost of installation of such machines.

In rice mills using horizontally arranged polishing machines, in order to avoid the high cost of elevators for grain, said machines are mounted in a cascade arrangement, that is, are mounted at different successive levels, whereby the installation of stairways and the like for inspection and repair purposes is required, which absorbs a greater space and involves a rather slower and intricate operation.

Compact type horizontal polishing and whitening machines for rice are also known, but these compact type machines use a rotor the rotation of which causes intermittent projection of the grains that therefore are accelerated or deccelerated, depending on the cycle involved, whereby the treating of the grain is harsh and irregular and a large amount of breakage of said grain occurs.

Most of the well known whitening and polishing machines for cereal grains, particularly for rice, generally use a cylindrical rotor and a polygonal indented screen, because it was believed up to the present time that the use of such polygonal indented screen would increase the performance of the apparatus, because the building up of a mass of grains in the corners of the polygonal screen would produce rotation between the different layers of grain and thus an energetic rubbing of the grains against each other, which supposedly would aid to the polishing of the grain in a more efficient manner. However, it has now been discovered that there is no reason whatsoever for maintaining the polygonal, particularly hexagonal shape of indented screens, because the said screens used in most of the prior art polishing or pearling machines for grains, do not perform as previously thought, and rather produce heavy accumulations of grains in the corners of the hexagonal screen, which grains are kept there without any treatment whatsoever.

The screen type machines of the prior art, on the other hand, generally use indentations in the screens that interfere with the slots of the screen, thereby forming extremely sharp protruding edges that materially form sharp knives that, rather than polishing the grain, cut the surface thereof and many times cut through the bodies of said grains with the consequent breakage and the obvious dissatisfactory uniformity of the polishing action achieved thereby.

Most of the above described drawbacks shown by all the prior art polishing or whitening machines for rice, have been appropriately solved by the whitening and polishing machine of U.S. Pat. No. 3,960,068 to Felipe Salete, the same applicant of the instant application. Said patent discloses a whitening and polishing machine essentially comprising a housing, a hollow rotor within said housing, feed means to admit grain into the housing, a screw conveyor at the lower part of said rotor for conveying the grains upwardly into the treating section of the machine which is arranged at the upper part of said rotor, a cylindrical indented screen in said treating section and a rotor having a pair of knives to retain the movement of the grains at will, whereby the pressure applied by said screw conveyor upwardly of the machine, pushes the grains to be trapped by said rotor which spins the mass of grains against the action of the indented screen, thus rubbing the grains one to each other and against the walls of the rotor and the walls of the indented screen, to thereby whiten and polish the same. The flour which is removed from the grains, is entrained in a stream of air which is forced through the hollow rotor and outwardly thereof through suitable bores, in order to cross the mass of spinning grains and the screen, so that said flour is taken out from the treating chamber of the machine and downwardly falls by gravity in order to be collected in an appropriate receptable. The treated grains in turn are pushed upwardly against a centrifugal extractor, which expels the same outwardly of the machine. The machine U.S. Pat. No. 3,960,068, while highly efficient and extremely economic in its operation, still presents some drawbacks, among which the following may be mentioned. The machine of U.S. Pat. No. 3,960,068 does not solve the problem extant in practically all rice mills, namely, that if the rice is not properly husked in the husking machines, an additional husking operation and/or unhusked grain removing operation is required in the husking stage, because the machine of U.S. Pat. No. 3,960.068 is absolutely unable to husk the unhusked grains received.

The machine of U.S. Pat. No. 3,960,068, on the other hand, may only be arranged in a vertical position, which reduces its versatility because there are many rice mills that require horizontal arrangement of polishing machines. Also, said machine is not capable of orienting either the feed means or the discharge means for grain, whereby the grains must be always fed in the same position and always discharged in the same position, respectively.

Said machine also lacks means to orient the position of the individual spinning grains, whereby some times the rotor or the indented screen traps the grains in a transverse position, producing serious breakage thereof and the percentage of said breakage may at times be relatively high, with the consequent uneconomical results.

It is therefore very well known that all the workers in the cereal grains husking, polishing and whitening field have long sought a machine that may be able to overcome the above described drawbacks and particularly a machine that may perform, in one single step, both the husking operation of the grains that were not completely husked by the husking machines, and the whitening and polishing thereof, in order to solve the very serious problem extant up to the present time in all prior art rice mills, namely, that the husking machines generally do not perform with 100% efficiency, whereby many individual grains are expelled from said machines with all or part of the husk covering them, thus requiring a further husking stage or an unhusked grain removing stage, because the prior art polishing and whitening machines were unable to treat the unhusked grains that were fed into the same. A machine which may solve the problem of husking the unhusked grains coming from the husking operation at the same time that it polishes and whitens the same, represents a breakthrough in the art and, therefore, such machine has been long sought, without any success up to the present time.

BRIEF SUMMARY OF THE INVENTION

Having in mind the defects of the prior art grain whitening and polishing machines, it is an object of the present invention to provide a grain polishing and whitening machine of very simple and compact construction and yet of very high efficiency as compared to all prior art machines.

It is another object of the present invention to provide a grain polishing and whitening machine of the above mentioned character, which will be capable of husking a high percentage of grains that may be left unhusked by the husking machines and will be capable of husking said grains and also polishing and whitening the same in one single step.

It is still one other object of the present invention to provide a grain polishing and whitening machine of the above identified character, which will be capable of carrying out the husking, polishing and whitening operations with low energy consumption and low space requirements and will be capable of installation in either vertical or horizontal positions.

Another and more particular object of the present invention is to provide a grain polishing and whitening machine of the above described character, which will produce a very high percentage of unbroken grains by being capable of orienting the grains under treatment to avoid breakage thereof.

It is another object of the present invention to provide a grain polishing and whitening machine of the above character, which will be capable of working at a very high speed and yet produce smoothly polished and whitened grains.

One other and more particular object of the present invention is to provide a grain polishing and whitening machine of the above described nature, which will be capable of working at relatively low temperatures in view of its capability to introduce fresh and cool air through the grain treating elements of the machine.

Still another object of the present invention is to provide a grain polishing and whitening machine of the above character, which will be capable of preventing adherence of the bran or flour produced when husking and polishing the grains, both to the machine parts and to the husked and polished grains, thusly avoiding the installation of auxiliary machines for removing the adhered flour and bran.

Still another and more particular object of the present invention is to provide a grain polishing and whitening machine that will be capable of having a movable grain inlet and a movable grain outlet, each of which may be rotated throughout the whole circumference around the machine.

Another object of the present invention is to provide a grain polishing and whitening machine of the above described nature, which will be capable of permitting easy removal of the screen for cleansing or replacement purposes.

One other object of the present invention is to provide a grain polishing and whitening machine of the above nature, which will have grain conveying elements that will not be easily worn out by the abrasive action of the unhusked grains entering therein and will instead have capability for husking said grains to be thereafter polished and whitened.

Another object of the present invention is to provide a grain polishing and whitening machine of the above described character, which will permit treatment of grains of different sizes through the mere adjustment of certain elements of the machine.

Still another object of the present invention is to provide a grain polishing and whitening machine of the above described character, which will permit the regulatable pneumatic removal of flour and bran from the machine, thus maintaining the mass of grains cool, which prevents breakage thereof and avoids the installation of false floors to recover said flour and bran by gravity.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment, when read in connection with the accompanying drawings, in which:

FIG. 4 is a cross-sectional elevational view similar to FIG. 1, showing all the inner details of the machine built in accordance with the present invention;

FIG. 5 is a detailed view of the part of the machine marked by the circle V in FIG. 4;

FIG. 6 is similarly a detailed view of the part of the machine marked by the circle VI on FIG. 4 of the drawings;

FIG. 9 is a cross-sectional fragmentary view of the indented screen shown in FIG. 8 of the drawings, at a larger scale in order to show the indentations and the slots thereof;

DETAILED DESCRIPTION

Figure 1:
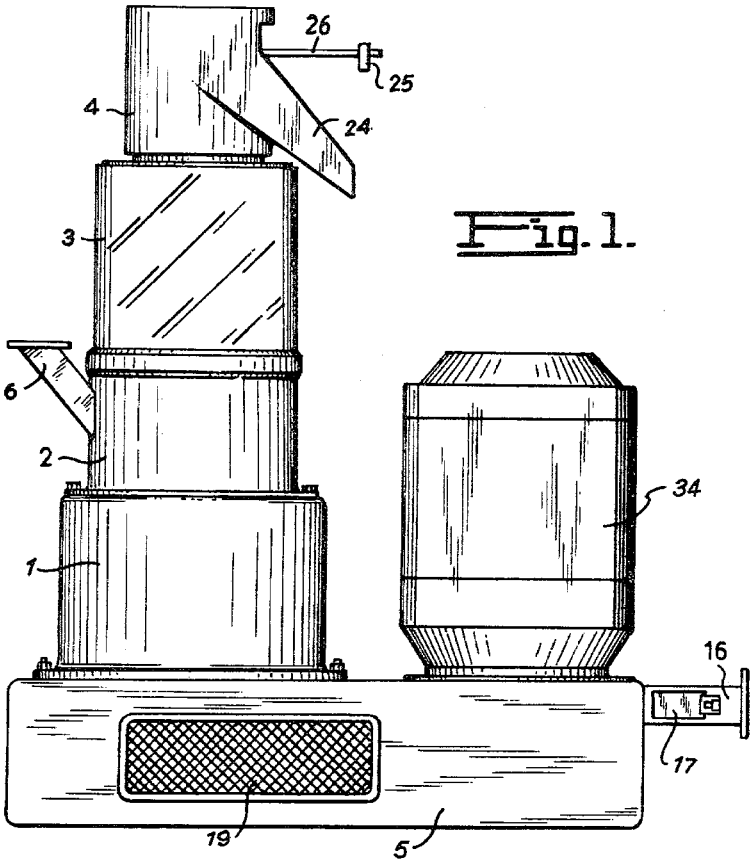
FIG. 1 is an elevational view of a grain polishing and whitening machine built in accordance with the present invention.
Figure 2:
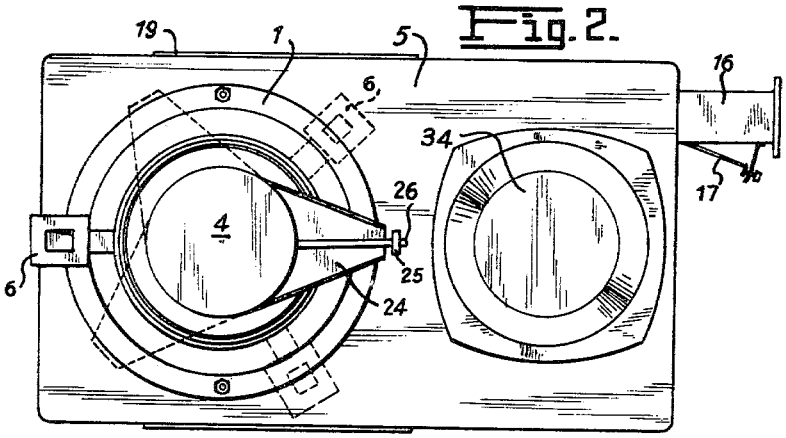
FIG. 2 is a top plan view of the machine shown in FIG. 1, illustrating by means of dotted lines the rotatably displaceable nature of both the grain inlet and the whitened and polished grain outlet.

Having now more particular reference of the drawings and more specifically to FIGS. 1 and 2 thereof, there is shown a machine for polishing and whitening rice grains, built in accordance with a particularly preferred illustrative but non limitative embodiment of the invention, and broadly comprising a grain treating housing formed by a lower or first housing section 1 mounted on top of the base box 5, a second housing section 2 mounted on top of section 1 and containing an inlet 6 for grain to be treated, said section 2 being rotatably displaceable with respect to section 1, by means that shall be described in more detail hereinafter; a third housing section 3 mounted on top of section 2 and having a wall of a transparent nature, built for instance of a plastic transparent material or the like, and which contains all the main treating elements of the machine, the transparent housing section 3 thus permitting continuous inspection of the treatment of the grain for appropriate control of the machine; and a top or fourth housing section 4 mounted on the upper end of the transparent section 3 and being rotatably displaceable with respect thereto, wherein the outlet 24 for treated grains is arranged. In view of the fact that sections 2 and 4 are rotatably displaceable with respect to the other sections, both the inlet 6 and the outlet 24 for grain may be moved to any desired position around the machine, thus providing a great versatility and convenience for loading and unloading the machine.

A motor unit 34 is also mounted on top of the base box 5, the latter serving as a housing for the drive elements between the motor 34 and the machine. Air may be driven into the base box 5 and through the machine by providing a window 19 covered by a suitable wire mesh and flour and bran-ladden air may be exhausted through the exhaust duct 16 which may be controlled by means of a suitable damper 17 to be described in detail hereinbelow.

The different positions that may be adopted by both the inlet 6 or the outlet 24 are clearly shown in FIG. 2 of the drawings by means of dotted lines, and it may be seen that the said inlet and outlet for grain may be arranged in any desired position throughout the circumference around the machine, whereby the feeding means to load grain into the machine may be placed in any desired position, and the outlet of treated grain may also be placed in any desired position for further treatment or storing of the grain.

More particularly, the grain polishing and whitening machine built in accordance with the preferred embodiment of the invention, as more clearly shown in FIGS. 3 to 9 of the accompanying drawings, comprises a base box 5 on which top a first or lower cylindrical housing section 1 is fixedly mounted by means of bolts and the like, said lower housing section having an inner cylindrical member 73 fixedly concentrically mounted within housing section 1 by means of a plurality of brackets such as that indicated by the reference numeral 65 in FIG. 4 of the drawings, for a purpose to be described hereinbelow. On top of the cylindrical housing 1 a radially inwardly directed flange 77 is provided for the purpose of receiving a movable second cylindrical housing section 2, which has a lower radially outwardly directed flange 73 abutting said flange 77 of housing section 1, for the purpose of providing for the displacement of the second housing section 2, by means of a mounting which is more clearly described in FIG. 5 of the drawings. The mounting of housing section 2 on housing section 1 for the purpose of enabling the displacement of housing section 2 with respect to housing section 1 in a rotative direction, comprises a planar ring 28 engaging the lower surface of flange 77 of housing section 1, and the above mentioned outwardly directed flange 73 located at the lower edge of housing section 2. The planar ring 28 and the flange 73 are engaged by means of a plurality of bolts 27 which are normally tightened when the machine is in operation but that may be loosened in order to enable rotation of the housing section 2 in any direction and to any position with respect to housing section 1. Housing section 2 has a grain inlet 6 diagonally mounted across the wall thereof, and an inner cylindrical member 74 is fixedly mounted concentrically inwardly of housing section 2, and coaxially above the cylindrical member 73 of housing section 1, for a purpose to be described hereinbelow, by means of a plurality of brackets such as bracket 66 shown in FIG. 4 of the drawings.

The rotatably displaceable mounting formed by ring 28, flange 73 and the plurality of bolts 27, enable location of the grain inlet 6 in any desired position throughout the circumference around the machine, so as to admit grain from a feeding means that may be located conveniently in the permises according to the space and other requirements of the mill.

On top of the displaceable cylindrical housing section 2 there is mounted a third cylindrical housing section 3 engaged to the cylindrical housing section 2 by any suitable means such as the surrounding band 80 shown in FIG. 4 of the drawings.

Concentrically arranged within housing section 3 an indented screen 10 which will be described in detail hereinafter, is suitably mounted coaxially above the inner cylindrical member 74 of housing section 2, by means of a screen holder which is more clearly shown in FIG. 8 of the drawings and comprising an upper and lower ring 31 provided with a plurality of lugs 50 having suitable bores 51. Both rings 31 are joined together by means of two vertical struts 32 and a plurality of planar rings 53 are arranged between struts 32 in order to maintain the shape of the indented screen 10 unaltered. The lower lugs 50 of the screen holder are fixedly mounted on matching lugs 79 provided on the outer surface of the top of inner cylindrical member 74, by means of bolts 78 as more clearly shown in FIG. 4 of the drawings, whereas the upper lugs 50, fixed on the upper ring 31 of the screen holder, are usd to mount thereon a cone-like member 29 more clearly shown in FIG. 6 of the drawings, by means of the outer flange 75 of said cone member 29 and a plurality of bolts 30 which engage said flange 75 to the plurality of upper lugs 50 of the screen holder.

Spanning the whole length of the cylindrical housing sections 1, 2 and 3, an inner hollow rotor member 20 is provided, concentrically inwardly of the inner cylindrical members 73 and 74 and the indented screen 10, for a purpose to be described hereinbelow, said rotor 20 being rotatably mounted by means of two suitable bearings 38 and 39, with bearing 38 being fixed on the inner wall of the lower portion of the cylinder member 73 and bearing 39 being fixed on the inner wall of the upper portion of said cylindrical member 73, so as to secure alignment of the rotor 20 with respect to the inner cylindrical members 73 and 74 and with the indented screen 10.

Mounted by means of a threaded portion 62 more clearly shown in FIG. 5 of the drawings and outwardly of the rotor 20, there is a screw conveyor provided with a helical rib whose upper wall is thoroughly lined by means of an abrasive and wear resistant lining 8 (as more clearly shown in FIG. 5 of the drawings), also for a purpose to be described hereinbelow.

Aligned with and on top of the screw conveyor 7, an upper projection 11 of the rotor 20 (hereinafter called rotor 11) is provided, wherein a plurality of vertical lines of bores 21, as more clearly shown in FIG. 7 of the drawings is provided also for a purpose to be described hereinbelow. This perforate rotor 11 is located concentrically inwardly of the indented screen 10 forming a space 9 therebetween which serves as the polishing and whitening chamber of the machine of the present invention, to be called hereinafter the treating chamber 9.

On top of the cylindrical housing section 3, there is mounted a fourth or upper cylindrical housing section 4, which is provided with the above described outlet 24 for treated grain and which contains an inner cylindrical member 22 fixedly and concentrically mounted within housing section 4 by means of brackets such as the one indicated by means of reference numeral 81 in FIG. 4 of the drawings. The inner cylindrical member 22 has an open slant top end covered by means of a lid 23 which is movable by being mounted on a hinge 63 which connects with an intermediate toggle portion of a bar 26 extending outwardly of the housing section 4 and having near its outer end a displaceable weight 25 for maintaining the lid 23 permanently engaged to the slant open end of the cylindrical member 22. The inner end of bar 26 is rockably supported on hinge 64 fixed on the upper cover of housing section 4, in order to provide for the movement of lid 23 from an open position to a closed position against the slant open end of the cylindrical member 22.

The housing section 4 is also rotatably displaceable with respect to the cylindrical housing section 3 by the provision of a mounting which is more clearly illustrated in FIG. 6 of the drawings and comprising a cylindrical upper portion 76 of the cone member 29, around which the inner cylindrical member 22 is mounted with a snug fit, whereas the lower edge of the cylindrical housing section 4 rests on the flange 75 of said conical member 29. By this type of mounting, the whole of the top cylindrical housing section 4 may be moved to any position around the circumference, by merely forcing the inner cylindrical member 22 to rotate sliding against the cylindrical portion 76 of conical member 29, while the said housing section 4 is supported on top of the flange 75 as clearly shown in FIG. 6 of the drawings. In this manner, the material outlet 24 may be rotated to any desired position for conveniency purposes, as shown by dotted lines in FIG. 2 of the drawings.

The indented screen 10, as more clearly shown in the fragmentary view of FIG. 9 of the drawings, is provided with a plurality of inclined slots 67 as more clearly shown in FIG. 8 of the drawings, and a plurality of indentations 68 throughout the surface of the said screen 10, the indentations 68 projecting inwardly of the screen 10, in order to provide teeth for trapping and rubbing grain which reaches the chamber 9 as will be described more fully hereinbelow.

Figure 8:
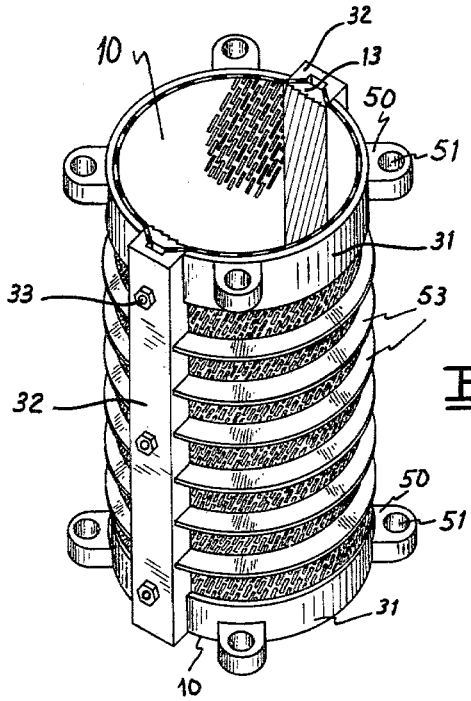
FIG. 8 is a conventional somewhat diagrammatic perspective view of the screen holder and the indented screen which is concentrically mounted around the rotor shown in FIG. 7 of the drawings.

The screen 10 is preferably formed by two halves as more clearly shown in FIG. 8 of the drawings, the vertical edges of which are placed coincidentally inwardly of the struts 32. A pair of removable diagonally fluted knives 13 is placed such that their pyramidal portions coincide with the edges of the two halves of the indented screen 10, and each of said diagonally fluted knives 13 is tightened against matching inner flared grooves provided along the struts 32, by means of a plurality of bolts 33, whereby the edges of the two halves of the indented screen 10 are fixedly but removably mounted on said struts 32 as clearly shown in FIG. 8 of the drawings. Said diagonally fluted knives 13 provided a serrated surface which is coplanar with the inner cylindrical surface of the indented screen 10 for a purpose also to be described in more detail hereinbelow.

Figure 3:
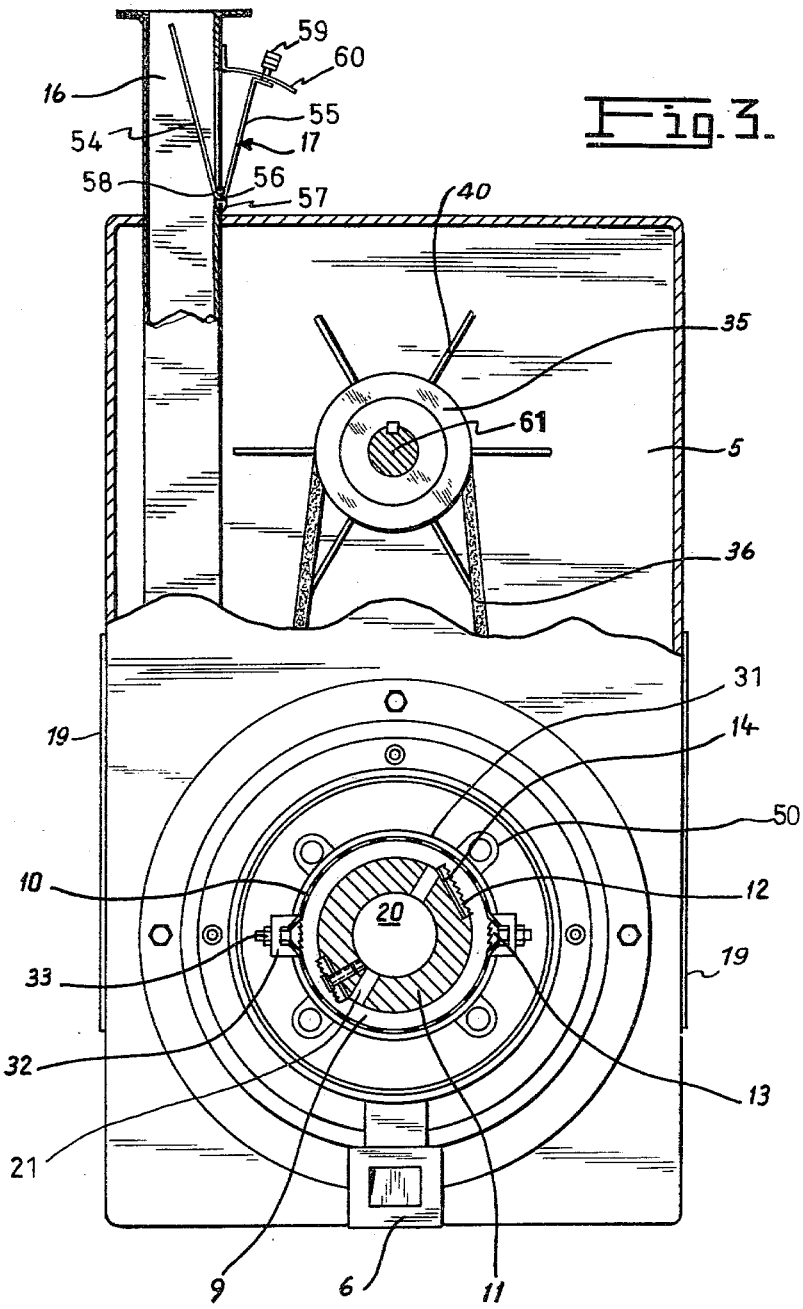
FIG. 3 is a cross-sectional top plan view of the grain polishing and whitening machine of the present invention with certain parts broken away to show inner details thereof.
Figure 7:
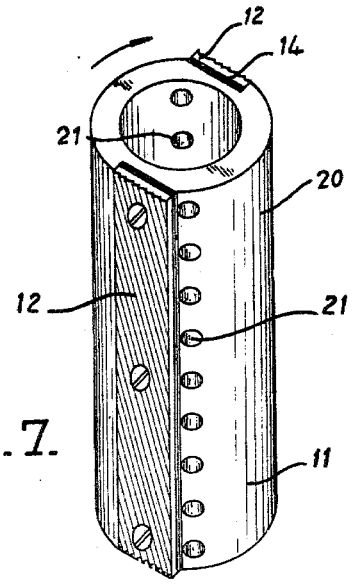
FIG. 7 is a conventional perspective view of the grain polishing and whitening rotor of the machine of the present invention.

The inner rotor 11 which is placed concentrically inwardly of the indented screen 10 comprises, as more clearly shown in FIG. 7 of the drawings, a plurality of vertical lines of bores 21, and two removable diagonally fluted knives 12, similar to the fluted knives 13, are provided on the outer surface of rotor 11, mounted in such a manner that one of the longitudinal edges of said knives is introduced in a complementary triangular section notch provided on the rotor 11, so that the serrated surface of the knives 12 is mounted tangentially of the circumference of the rotor 11 as more clearly shown in FIG. 3 of the drawings. The spacing of the fluted knives 12 with respect to the screen 10 and the fluted knives 13 may be regulated by means of a plurality of removable shims 14 which are introduced between the inner surface of each fluted knife 12 and the surface of each triangular notch of housing 11, said adjustable spacing of the serrations of each knife 12 with respect to the serrated surfaces of the knives 13, being used to regulate the treatment of the grains as will be more clearly described hereinbelow.

Around the lower open end of the rotor 20, a pulley 37 is fixedly mounted, said pulley being engaged, by means of the bands 36, to a pulley 35 engaged to the shaft 61 of motor 34 also mounted on base box 5. The pulley 35 on the shaft 61 of the motor 34 is provided with a plurality of fan blades 40 capable of blowing air to cool the bands and pulleys contained within the base box 5. Above the pulley 37 and fixedly mounted on rotor 20, there is provided a fan having a plurality of vanes 15 arranged within a volute-type housing 72, said housing 72 being connected to the exhaust duct 16 for flour and bran-ladden air, said duct being connected to a pneumatic conveyor (not shown) which applies a high vacuum suction thereto and being provided, outwardly of the base box 5 as more clearly shown in FIGS. 3 and 4 of the drawings, with a damper 17 to regulate the exhaust and comprising an inner or damper portion 54 (FIG. 3), connected by means of an angular portion 56 to an outer control member 55, said angular portion 56 being rockably mounted between the packing members 57 and 58, to be movable between an open position and a closed position, the control outer member 55 having a screw 59 which runs within a slot provided in a curved member 60 engaged to duct 16, for enabling fixation of the damper 17 at any desired position to open or close the exhaust 16 for flour and bran-ladden air.

As a preferred embodiment of the invention, the operation of the machine described above will be explained considering the treatment of rice, and considering that, in most of the rice mills, the husking machines leave a relatively important proportion of unhusked rice grains, which in the prior art mills require a second husking stage or an unhusked grain removing stage because the prior art polishing and whitening machines, as already described above, are not capable of husking the grains and, thus, said machines must receive the rice in a completely husked condition, in order to be effective in the whitening and polishing operations. The load of rice with a proportion of unhusked grains is charged to the machine through the inlet 6 into the inner cylinder member 74 of housing section 2 of the machine, while the rotor 20 is being rotated by the drive formed by motor 34, pulley 35, bands 36 and pulley 37.

The helical or screw conveyor 7 takes the rice load and pushes it upwardly of the machine, with the proportion of unhusked rice being energetically rubbed by the abrasive lining 8 shown in FIG. 5 of the drawings, said rubbing operation accomplishing an effective husking of the grains, in order that the vast majority of said grains reaching the treatment chamber 9 will be completely husked for achieving a full whitening and polishing operation to produce an optimal quality rice. The rice being pushed upwardly into chamber 9 between the rotor 11 and the indented screen 10, is compacted in said chamber 9 because the rotation of rotor 11, as shown by the arrow in FIG. 7 of the drawings, moves the diagonally fluted knives 12 in a direction that tends to push the grain downwardly, in opposition to the pushing action of the screw conveyor 7, whereby the mass of rice going up the machine is heavily compacted in the chamber 9 of the housing section 3. The indentations 68 of the screen 10, together with the compacting action caused by the rotation of the diagonally fluted knives 12 of rotor 11 that press the grains forming a mass in which said grains are heavily packed against each other, energetically rubs the grains against each other and against the indented screen 10, said action being accomplished in view of the fact that the mass of grains rotates partially adhered to rotor 11.

The tangential arrangement of the fluted knives 12, on the other hand, exerts a wedge-like action on the compacted mass of grains to cause the grains to adopt a position that may be variable but never with the long axes of the grains placed radially of the machine, said placement of the long axes of the rice grains being achieved as the rotor 11 rotates in the direction of the arrow shown in FIG. 7 of the drawings, that is, in the direction which goes from the point of contact of the circumference and the tangents formed by the fluted knives 12, towards the protruding portion of said fluted knives, which therefore act as an orienting wedge on the grains.

The rubbing action is intensified by the existence of the diagonally fluted knives 13 inserted in the joint of the two halves forming the body of the indented screen 10. These fluted knives 13, obviously, are static as opposed to the rotating fluted knives 12 located in the rotor 11, and act in cooperation therewith both to energetically rub the grains and to place the long axes of the grains properly to prevent breakage thereof, as described above.

The spacing between the knives 12 and the indented screen 10 may be changed, in accordance wth the size of the grain by inserting or removing, as the case may be, one or more shims 14, that is, by removing some of said shims when the grain is larger or by inserting more shims when the grain is smaller.

The operation of the treating chamber 9 may be easily controlled because the housing section 3, as described above, is transparent, which permits the visual inspection of the color of the flour or the bran, which is an indication of the degree of treatment of the rice.

The flour and bran produced by the husking and whitening of the grains, pass from the treating chamber 9 through the slots 67 of the indented screen 10, driven by the sum of the effects of the pressure of the mass of grains, the centrifugal force caused by the rotation of rotor 11, and the suction produced by the vanes of fan 15, located at the lower part of rotor 11 within the base box 5 of the grain treating machine.

The flour and bran extracted from the treating chamber 9 pass downwardly through the annular spaces formed between the screen 10 and the housing section 3, the inner cylindrical member 74 and housing section 2, and the inner cylindrical member 73 and the housing section 1, and into the volute housing 72 wherein the fan 15 operates, and hence through the exhaust 16 outwardly of the machine. The outlet of the flour and bran-ladden air is controlled by means of the damper 17 and, if desired, may be accelerated by the addition of vacuum action exerted by a pneumatic conveyor (not shown) which may be connected at the outlet of exhaust 16.

Without any desire to be bound to any kind of theoretical explanation of the reason why the machine of the present invention is capable of effecting husking of the grains as well as polishing and whitening thereof, it is belived that the grains form a mass having very special characteristics within treating chamber 9, in view of the fact that, on the one hand, this is a compacted mass which is moved partially adhered to rotor 11 and is rubbed against the indented screen 10 and the fluted knives 12 whereas, on the other hand, the air forced by the induction of fan 15 and the external pneumatic conveyor and circulating between the grains, forms a sort of a lubricant between them and maintains them cool and spaced from each other by a short distance which, when the mass of grains is rotated, permits the grains to impact each other, thereby causing shocks that increase the husking action accomplished by the machine built in accordance with the present invention on the rice grains. The action of this air stream, also, is to fully remove the released flour and bran from the machine parts and from the surfaces of the already polished and whitened grains, thus avoiding frequent machine cleaning operations, as well as the use of flour and bran-removing machines as a further stage of the mill process, which represents one other breakthrough with respect to all prior art machines.

The processed grain, already fully husked, whitened and polished in the treating sections of the machine of the present invention, passes into the housing section 4 entering the inner cylindrical member 22 through the conical element 29, and pushes the lid 23 supported on its 63 and 64, overcoming the weight 25 placed at the outer end of the bar 26, in order to open the mouth of the cylindrical member 22 and permit the grain to travel outwardly of the machine through the outlet 24. The weight 25 may be placed on the bar 26 at any distance from hinge 63, thereby increasing or decreasing the lever action, whereby the pressure exerted by the lid 23 on the outwardly moving mass of treated grains may be varied at will, in order to control the flow of grain through the outlet 24.

Another important characteristic of the machine built in accordance with the present invention is that its operational efficiency is considerably increased by the fact that the indented screen 10 may be removed from the machine for maintenance purposes, by the mere operation of removing housing section 4 which may be pulled upwardly of the cylindrical portion 76 of the cone member 29, whereafter the bolts 30 and bolts 78 are removed, thus releasing the whole of the screen holder which may be then removed from the machine for replacement or repair purposes. Also, the screw conveyor 7 may be removed from the machine by the mere operation of fixing the rotor 20 and unscrewing the member 7 by rotating it, in order to release the threads 62, which action is achieved by rotating the screw conveyor 7 preferably in the same direction of rotation of the rotor 20.

As shown in FIGS. 10 through 17 of the drawings, it may be seen that the grain polishing and whitening machine built in accordance with the present invention may be mounted in a great variety of arrangements, to satisfy the needs of any particular mill.

Figure 10:
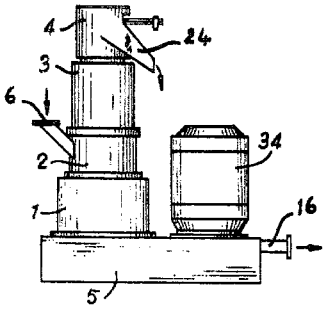
FIG. 10 is an elevational view of the machine built in accordance with an embodiment similar to that of FIG. 1 and installed in a vertical position.
Figure 11:
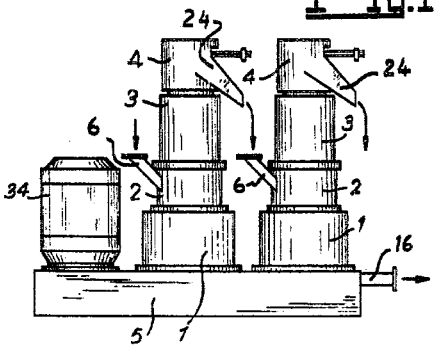
FIG. 11 is an elevational view of a tandem formed by two machines of the invention mounted in series on the same base box to achieve a more perfect husking, polishing and whitening of the grains.

Thus, in FIG. 10 there is shown a mounting of the machine as per the embodiment already described in connection with FIGS. 1 to 9, whereas in FIG. 11 there is shown an arrangement of two vertically disposed machines, with the outlet 24 of the first machine discharging directly into the inlet 6 of the second machine, forming a tandem-type arrangement to more fully polish and whiten the grains, as well as to fully husk the unhusked grains reaching the inlet 6 of the first machine, this arrangement being highly useful, for instance, when treating pairboiled rice grains.

Figure 12:
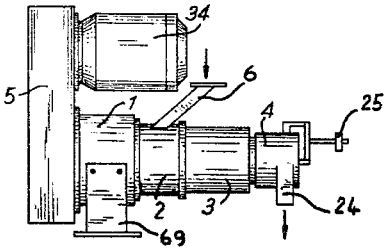
FIG. 12 is a side elevational view of the machine built in accordance with the present invention, but mounted in a horizontal position and with the motor above.
Figure 13:
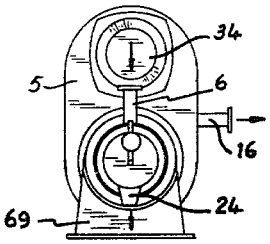
FIG. 13 is an elevational view of the machine built in accordance with still another embodiment of the invention, suitable for horizontal mounting and with the motor aside.

FIGS. 12 and 13 show a horizontal arrangement of the machine with the grain polishing and whitening below and the motor 34 above, with the inlet 6 arranged to receive the material downwardly and the outlet 24 downwardly directed to discharge the material on a suitable conveyor. The arrangement shown in FIGS. 12 and 13 is supported by means of a pedestal 69 to suitably maintain the machine in the horizontal position.

Figure 14:
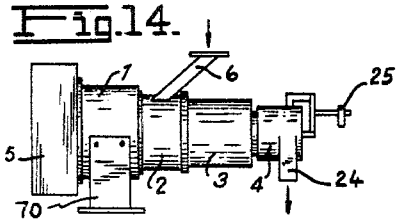
FIG. 14 is an elevational view of a machine built in accordance with still another embodiment of the invention, suitable for horizontal mounting and with the motor aside.
Figure 15:
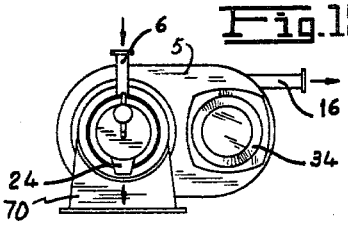
FIG. 15 is a side view of the machine shown in FIG. 12.

FIGS. 14 and 15 show an arrangement which has the machine horizontally arranged in the same manner as that illustrated in FIGS. 12 and 13, but with the motor 34 at the same level and behind the machine, and the inlet 6 and outlet 24 arranged in the same manner as those of FIGS. 12 and 13. This horizontal arrangement of the machine is also supported by means of a pedestal 70.

Figure 16:
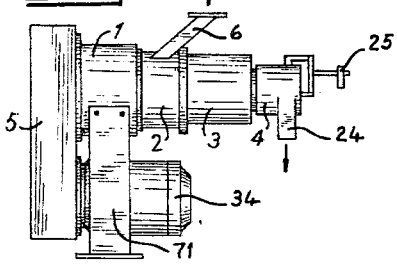
FIG. 16 is an elevational view of a machine mounted in accordance with still one other embodiment of the invention, with a horizontal arrangement and with the motor installed below the machine.
Figure 17:
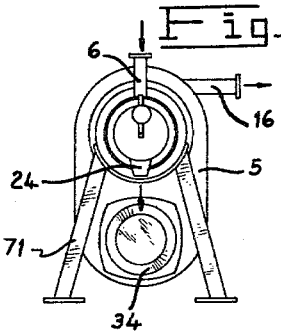
FIG. 17 is a side view of the machine shown in FIG. 16.

Finally, the arrangement shown in FIGS. 16 and 17 is also horizontal and similar to FIGS. 12 to 15, but with the motor below and the machine above, the machine being supported by means of a plurality of legs 71 which leave sufficient space for accomodating the motor 34.

In all the horizontal arrangements, the lid 23 of housing section 4 is controlled by means of the weight 25 but changing the lever system in order to act on the lid as will be easily apparent to any one skilled in the art.

From the above, it may be seen that for the first time a grain treating machine has been provided which not only serves for effectively polishing and whitening grains, but which also admits a large proportion of unhusked grains, in view of the fact that it is provided with suitable elements to also husk the grain, whereby the husking and polishing and whitening operations are effected in one single step and with one single machine, contrary to the prior art systems wherein generally a second stage of husking machine and/or an additional stage of unhusked grain removing machines becomes necessary in order to deliver fully husked grain to the polishing and whitening machines.

The versatility of this machine is increased by the movable inlet and outlet for grain, which may be placed at any desired position throughout the circumference around the machine, and thus provide a convenient location for any type of conveyors that may feed the grain and may extract the treated grain from the machines.

Also, the pneumatic extraction of the flour and bran, through the use of the combined action of an induction fan built within the machine and a pneumatic high vacuum conveyor externally mounted with respect to the machine and connected therewith by means of a valved exhaust duct, provide for an effective cooling of the grains avoiding undue breakage thereof and also for a complete removal of the flour and both bran from the machine parts and from the polished grains, thus avoiding frequent cleansing of the machine and the use of flour and bran-removal machines.

Although certain specific embodiments of the present invention have been described and shown above, it is to be understood that many modifications are possible. The invention, therefore, is not to be restricted except insofar as is necessitated by the prior art and by the spirit of the appended claims.

What I claim is:

1. A grain polishing and whitening machine comprising base box means, housing means having first, second, third and fourth coaxially arranged separate housing sections, said first housing section being fixedly mounted on said base box means, said first and second housing sections having an inner concentric cylindrical member forming annular passage means therethrough, concentric hollow rotor means extending through said first, second and third housing sections and opening into said base box means, bearing means in said first housing section to rotatably support said rotor means, drive means in said base box means to rotate said rotor means, fan means to cause air to flow into and through said hollow rotor means and out of the machine through said annular passage means, grain inlet means arranged through the wall of said second housing section, screw conveyor means engaged to said rotor means within said second housing section and capable of pushing the grain from said grain inlet means to said third housing section, said screw conveyor means having a helical rib lined with an abrasive layer at least on its forward surface, cylindrical indented screen means in said third housing section and having inclined elongated slots and inwardly extending indentations throughout its surface, said screen means being concentrically arranged around said rotor means and forming a grain treating chamber therebetween, a plurality of radial bores in said rotor means to allow air to flow in said treating chamber and through the mass of grains and outwardly of the slots of said screen means, said rotor means having a pair of longitudinally arranged, diametrically opposed, tangentially mounted, adjustable diagonally fluted, removable knife means directly confronted and spaced from said screen means, the flutes of said fluted knife means being inclined in a direction such that rotation thereof will cause a flow of grain opposed to the flow of grain produced by said screw conveyor means in order to compact the mass of grains in said treating chamber, a pair of longitudinally arranged, diametrically opposed, diagonally fluted, removable knife means mounted on said screen means to cooperate with said knife means mounted on said rotor means, and grain outlet means arranged in said fourth housing section.

2. A grain polishing and whitening machine according to claim 1 wherein said section housing section is coaxially mounted on said first housing section by means of a mounting that may be loosened to permit the rotatable displacement of said second housing section with respect to said first housing section, whereby the said grain inlet means may be placed at any desired position around said housing means.

3. A grain polishing and whitening machine according to claim 2 wherein said fourth housing section is coaxially mounted on said third housing section by means of a loose but snug fit mounting which permits the rotatable displacement of said fourth housing section with respect to said third housing section, whereby the said grain outlet means may be placed at any desired position around said housing means.

4. A grain polishing and whitening machine according to claim 3 wherein said grain outlet means comprise a duct concentrically arranged within said fourth housing section and directly communicating at one end thereof with said grain treating chamber, removable lid means covering the opposite open end thereof and yieldably forced against said open end, and discharge chute means radially arranged through the wall of said fourth housing section, the inner end of said chute means being communicated with said duct when said removable lid means is removed and the outer end of said chute means being open to freely discharge treated grain outwardly of the machine.

5. A grain polishing and whitening machine according to claim 1 wherein said fan means comprise fan blade within said base box means to drive air from the outside of said base box means through appropriate air inlet means, and hence into said hollow rotor means, induction fan vanes arranged within a volute type housing communicating with said annular passage in said housing means at the extreme portion of said first housing section, to induce a stream of air through said hollow rotor means, the radical bores of said rotor means, the treating chamber between the rotor means and the screen means, through said screen means, and said annular passage in said housing means, thus fully entraining the flour and bran released from the grains, and vacuum exhaust means communicating with said volume type housing to permit the exhaustion of the flour and bran-ladden air induced by rotation of said induction fan vanes outwardly of the machine.

6. A grain polishing and whitening machine according to claim 5 wherein said vacuum exhaust means comprise a duct tangentially arranged in said volute-type housing, flow regulating damper means in said duct, and high vacuum pneumatic conveyor means connected to the outer end of said duct.

7. A grain polishing and whitening machine according to claim 1 wherein said screw conveyor means comprises a helical rib only the attacking or forward surface of which is lined with a layer of an abrasive material.

8. A grain polishing and whitening machine according to claim 1 wherein said cylindrical indented screen means include screen holder means comprising a cylindrical frame having diametrically opposed longitudinal struts, each of said struts being formed with a longitudinal inner groove having a prism-like cross section, and two semicylindrical indented screen halves, the longitudinal edges of said semicylindrical indented screen halves being engaged to said diametrically opposed struts of said screen holder means by engagement of said diagonally fluted stationary knife means within the grooves of said struts, having the said edges of the screen halves removably pressed therebetween.

9. A grain polishing and whitening machine according to claim 1 wherein said first, second, third and fourth coaxially arranged housing sections are arranged in a vertical position.

10. A grain polishing and whitening machine according to claim 1 wherein said first, second, third and fourth coaxially arranged housing sections are arranged in a horizontal position.

11. A grain polishing and whitening machine according to claim 1 wherein said longitudinal, diametrically opposed, tangentially mounted, adjustable, diagonally fluted, removable knife means are mounted within longitudinal grooves provided on the surface of said rotor means, said grooves having a rectangular section the deepest portion or apex of which coincides with the forward edge of said knife means with respect to the direction of rotation of said rotor means, to thereby provide a wedge-type movable nip action on the mass of grains within the machine, to orient the individual grains in a longitudinal position with respect to said removable nip and prevent breakage thereof.

12. A grain polishing and whitening machine according to claim 11 wherein a plurality of shims are mounted between the back of said removable knife means and the bottom of said grooves of said rotor means, to enable adjustment of the spacing between the serrations of said knife means and the inner surface of said screen means, through the insertion or the removal of some or all of the shims.

13. A grain polishing and whitening machine according to claim 1 wherein said third housing section comprises a cylindrical transparent wall to permit the continuous inspection of said screen means during operation of the machine, to thereby visually inspect the characteristics of the flour and bran entrained in the air stream passing outwardly of the slots of said screen means.

* * * * *